US008990979B1

(12) United States Patent
Craver et al.

(10) Patent No.: US 8,990,979 B1
(45) Date of Patent: Mar. 31, 2015

(54) READY-TO-ASSEMBLE BED FOUNDATION

(71) Applicants: Larry J Craver, Winston-Salem, NC (US); Dean F Lail, Asheboro, NC (US)

(72) Inventors: Larry J Craver, Winston-Salem, NC (US); Dean F Lail, Asheboro, NC (US)

(73) Assignee: Larry J. Craver, Winston-Salem, NC (US)

( * ) Notice: Subject to any disclaimer, the term of this patent is extended or adjusted under 35 U.S.C. 154(b) by 0 days.

(21) Appl. No.: 14/224,192

(22) Filed: Mar. 25, 2014

(51) Int. Cl.
*A47C 19/00* (2006.01)
*A47C 19/02* (2006.01)

(52) U.S. Cl.
CPC ..... *A47C 19/005* (2013.01); *A47C 19/021* (2013.01); *A47C 19/02* (2013.01); *A47C 19/025* (2013.01)
USPC ..... 5/400

(58) Field of Classification Search
CPC .... A47C 19/02; A47C 19/021; A47C 19/025; F16B 12/54; F16B 12/56
USPC ..... 5/288, 291, 292, 295, 303, 200, 200.1, 5/282.1, 285, 286; 403/408.1, 205, 231, 403/382, 403, 169, 176, DIG. 10, DIG. 11, 403/DIG. 13
See application file for complete search history.

(56) References Cited

U.S. PATENT DOCUMENTS

| | | | | |
|---|---|---|---|---|
| 1,496,555 | A * | 6/1924 | Novitzky | 5/295 |
| 2,657,439 | A * | 11/1953 | Levine | 403/231 |
| 3,842,451 | A | 10/1974 | McCormick | 5/200 R |
| 4,065,818 | A * | 1/1978 | Farina | 5/288 |
| 4,155,131 | A | 5/1979 | Harris et al. | 5/296 |
| 4,181,991 | A | 1/1980 | Morgan et al. | 5/400 |
| 4,535,494 | A | 8/1985 | Diamonstein | 5/400 |
| 4,675,929 | A | 6/1987 | Santo | 5/400 |
| 4,870,711 | A | 10/1989 | Felix | 5/200 R |
| 4,970,743 | A | 11/1990 | Wride et al. | 5/451 |
| 5,012,538 | A | 5/1991 | Timm | 5/200.1 |
| 5,144,706 | A | 9/1992 | Walker | 5/400 |
| 5,469,589 | A | 11/1995 | Steed et al. | 5/400 |
| 5,564,140 | A | 10/1996 | Shoenhair et al. | 5/400 |
| 5,709,500 | A | 1/1998 | Mizelle et al. | 403/364 |
| 5,758,372 | A | 6/1998 | Lopez Diaz | |
| 6,058,535 | A | 5/2000 | Firkins, Jr. et al. | 5/653 |
| 6,418,578 | B1 * | 7/2002 | Polevoy et al. | 5/200.1 |
| 6,832,397 | B2 | 12/2004 | Gaboury et al. | 5/201 |
| 6,851,140 | B2 | 2/2005 | Polevoy et al. | 5/200.1 |
| 7,703,155 | B1 * | 4/2010 | Roberts et al. | 5/400 |
| 7,861,339 | B2 * | 1/2011 | Harrow | 5/201 |
| 7,900,300 | B1 * | 3/2011 | Roberts et al. | 5/400 |
| 8,042,205 | B2 * | 10/2011 | Schulz, Jr. | 5/200.1 |
| 8,122,537 | B1 * | 2/2012 | Roberts | 5/400 |
| 8,572,777 | B1 * | 11/2013 | Schulte | 5/400 |
| 8,584,277 | B1 * | 11/2013 | Roberts | 5/400 |
| 8,806,677 | B1 * | 8/2014 | Bartelsmeyer et al. | 5/400 |
| 2002/0069462 | A1 | 6/2002 | Gaboury et al. | 5/201 |
| 2003/0084509 | A1 | 5/2003 | Harrow | 5/201 |
| 2004/0078896 | A1 | 4/2004 | Hellyer et al. | 5/400 |
| 2004/0078897 | A1 | 4/2004 | Gladney | 5/400 |
| 2004/0128761 | A1 | 7/2004 | Gaboury et al. | 5/400 |
| 2004/0199997 | A1 * | 10/2004 | Harrow | 5/201 |

(Continued)

*Primary Examiner* — Robert G Santos
*Assistant Examiner* — David E Sosnowski
(74) *Attorney, Agent, or Firm* — MacCord Mason PLLC

(57) ABSTRACT

A ready-to-assemble bed foundation including a pair of exterior beams connectable to a pair of transverse end members having openings, and an interior beam between the exterior beams having opposing end portions configured to engage the openings in the transverse end members. A method of selling a bed, and a method of assembling a bed are also disclosed.

11 Claims, 7 Drawing Sheets

(56) References Cited

U.S. PATENT DOCUMENTS

| | | | | |
|---|---|---|---|---|
| 2005/0005357 | A1 | 1/2005 | Van Raemdonck | 5/617 |
| 2005/0011005 | A1 | 1/2005 | Borda | 5/412 |
| 2005/0028274 | A1 | 2/2005 | Hooper, Jr. | 5/400 |
| 2005/0028275 | A1 | 2/2005 | Hooper, Jr. | 5/400 |
| 2005/0034233 | A1 | 2/2005 | Gladney | 5/400 |
| 2005/0039258 | A1 | 2/2005 | Gavela Vazquez | 5/400 |
| 2005/0039259 | A1 | 2/2005 | Gladney | 5/400 |
| 2005/0091745 | A1 | 5/2005 | Kong | 5/201 |
| 2005/0120478 | A1 | 6/2005 | Hofmann | 5/400 |
| 2008/0208709 | A1 | 8/2008 | Craver | 705/27 |
| 2009/0025146 | A1* | 1/2009 | Mazzei et al. | 5/643 |
| 2014/0109313 | A1* | 4/2014 | Rohr | 5/282.1 |
| 2014/0137337 | A1* | 5/2014 | DeFranks et al. | 5/723 |

* cited by examiner

READY-TO-ASSEMBLE BED FOUNDATION

BACKGROUND

The disclosure is directed to a ready-to-assemble bed foundation. More specifically, the bed foundation includes a pair of exterior side beams connectable to a pair of transverse end members having openings. The foundation also includes an interior beam between the side beams having opposing end portions configured to engage the openings in the transverse end members.

Ready-to-assemble bed foundations are known. Many are expensive and difficult to assemble, while others are of the type having a solid panel immediately below a mattress or box spring. These panels are often bulky or otherwise not suited to cost-effective shipping and storage. Other prior art foundations prevent access to the area below the mattress for storage, or do not provide for the addition of a slipcover. Thus, the prior art has not adequately addressed the need for a ready-to-assembly bed foundation that is economical to manufacture and easy to assemble, provides a comfortable yet stable support, permits access to a storage area under the bed, and provides for the addition of a slipcover.

SUMMARY OF THE DISCLOSURE

The present invention fulfills one or more need in the art by providing a ready-to-assemble bed foundation including a pair of exterior side beams having two ends, a pair of transverse end members having two ends, each of the side beams and end members having a corner block attached to each end, and a pin with a flange for each pair of corner blocks. The corner blocks are configured to mate together to hold a side beam in contact at a right angle to an end member and to be held together by the pin, the corner blocks having a mounting flange to mount the block to the respective beam and upstanding lamella that can interleave with lamella of an adjacent block. Each lamella has a shaped lumen that is coaxial with the lumens of the other lamella of the block and has at least portions that are substantially cylindrical, so that each lumen can receive the pin. A lumen of an end lamella of one block includes a circumferential recess making a space for a flange of the pin. A lumen of the adjacent lamella of the other block includes a keyway providing a path for the flange of the pin to pass through when the pin is inserted into the aligned lumens so the flange can reside within the circumferential recess.

The circumferential recess may extend three quarters of the way around the lumen. In some embodiments the corner blocks are identical. One or more of the lumens may be arch-shaped.

Preferably, the pin is hollow. In an embodiment, a foot has a threaded rod at its top, so the threaded rod can be passed through the pin and held in place with a nut, providing a foot to hold the foundation off of a floor. A slipcover may be included for placement over the foundation. A collapsible mattress may be included. Typically, slats are included that can be installed to span the exterior beams as assembled.

These and other embodiments of the foundation will become apparent to those skilled in the art after a reading of the following description of the preferred embodiment when considered with the drawings.

DESCRIPTION OF THE VARIOUS EMBODIMENTS

The illustrations and descriptions thereof are for the purpose of describing embodiments of a bed foundation, and are not intended to limit the invention to any particular embodiment shown or described. Those of ordinary skill will recognize that the foundation described by the appended claims is subject to numerous embodiments.

Figure 1:
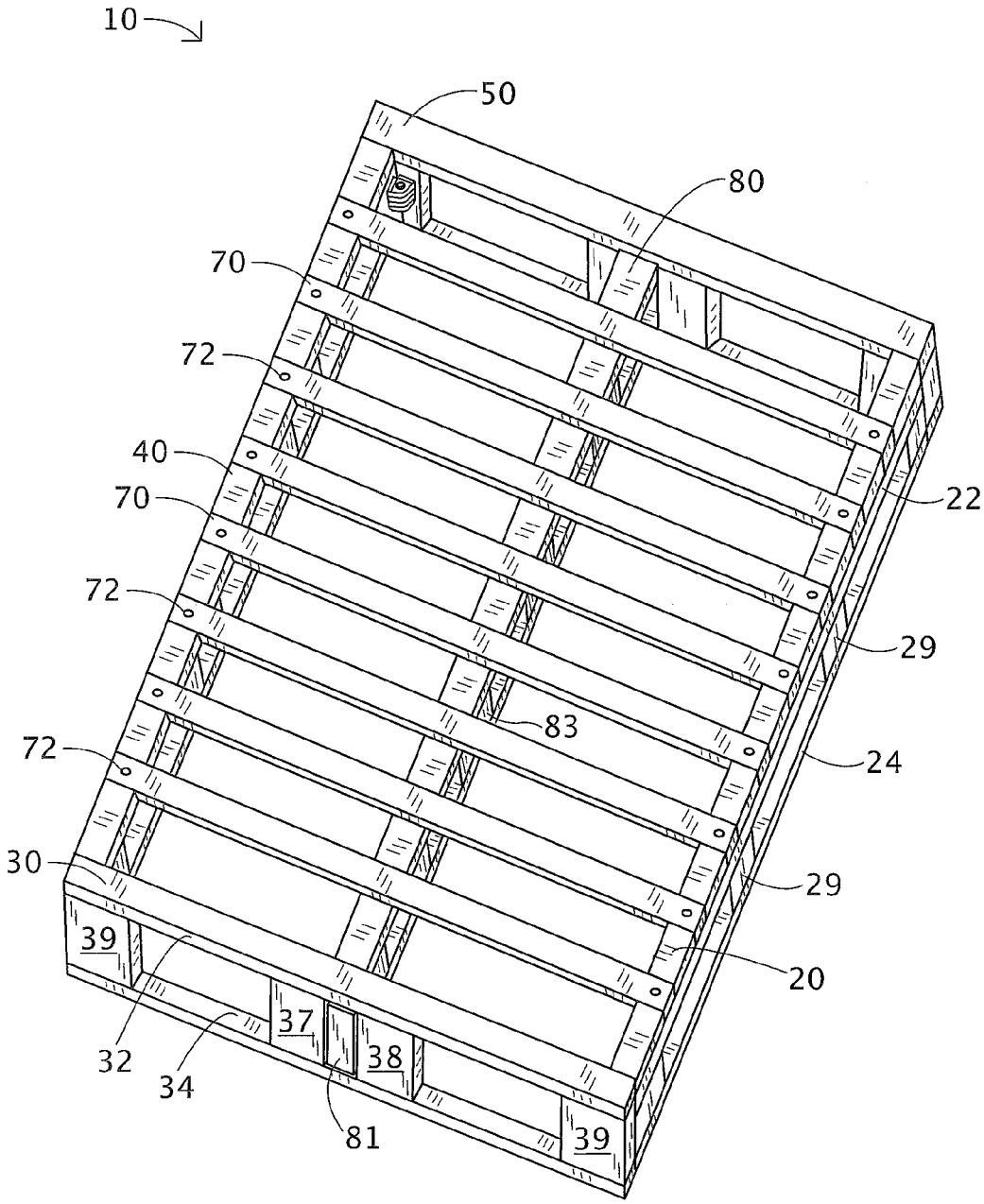
FIG. 1 is a top perspective view of an embodiment of a ready-to-assemble foundation for a bed.

FIG. 1 shows a foundation 10 for a platform bed. The foundation 10 includes a pair of exterior side beams 20 and 40 extending longitudinally between a pair of transverse end members 30 and 50 to form a generally rectangular outer frame. An interior support beam 80 may optionally be centrally located between the beams 20 and 40. Each of a plurality of flexible, spaced apart slats 70 extends longitudinally from one of the exterior side beams 20 or 40 to the interior beam 80 and has a top surface generally coplanar with the top surface of the frame.

The exterior side beam 20 is substantially identical to the beam 40 and includes an upper 22 and lower member 24 spaced vertically by a plurality of blocks 29 between the members 22 and 24. The upper member 22 includes a plurality of spaced apart slots for receiving the slats 70 and provide, with ends of the slats 70, a generally planar top surface for the frame.

The transverse end member 30 is substantially identical to the member 50 and includes a pair of longitudinal members 32 and 34 spaced vertically by a plurality of blocks 37, 38 and 39. The blocks 37 and 38 are spaced to provide an opening sized and positioned for receiving an end portion 81 of the interior beam 80. In the embodiment of the foundation 10 shown in FIG. 1, the opening between the blocks 37 and 38 is slightly larger than the end portion 81, which allows the end portion 81 to float within the opening. This allows the interior beam 80 to move slightly while being retained in place. Such movement provides "give" when an occupant of the bed moves.

Figure 2:
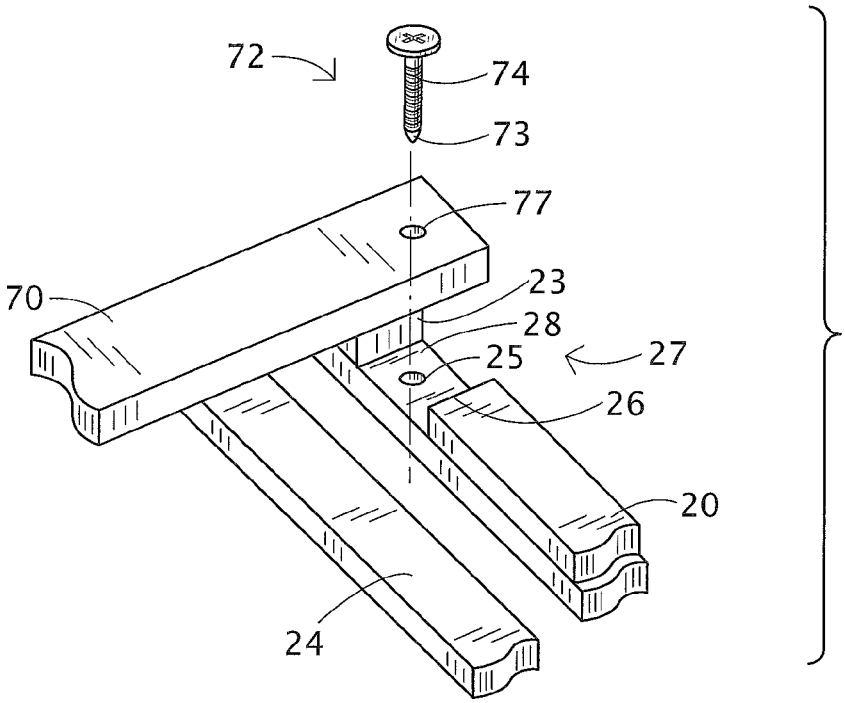
FIG. 2 is an enlarged top perspective view of fastening system for joining slats to the foundation.

FIG. 2 shows a fastener 72 for repeatedly coupling to and removing the slat 70 from the exterior side member 20, which includes slots such as the slot 27 defined by opposing walls 23 and 26 and a substantially horizontal surface 28 between the walls 23 and 26. The slat 70 includes an opening 77 and the surface 28 includes an opening 25 for receiving a fastener 72, which has stem 73 surrounded by a flexible flanges 74. Fasteners 72 are of the type often referred to as "Christmas tree" fasteners. The openings 77 and 25 are sized to provide engagement between the slat 70 and the beam 20 that remains intact during ordinary use of the foundation yet without the need for special tools permits removal of the fastener 72, enabling removal of the slat 70 for storage or transportation of the foundation. Each slat 70 includes an opening at its opposite end like the opening 77 for receiving an additional fastener 72 and the beam 40 shown in FIG. 1 includes openings such as the opening 77.

Figure 3:
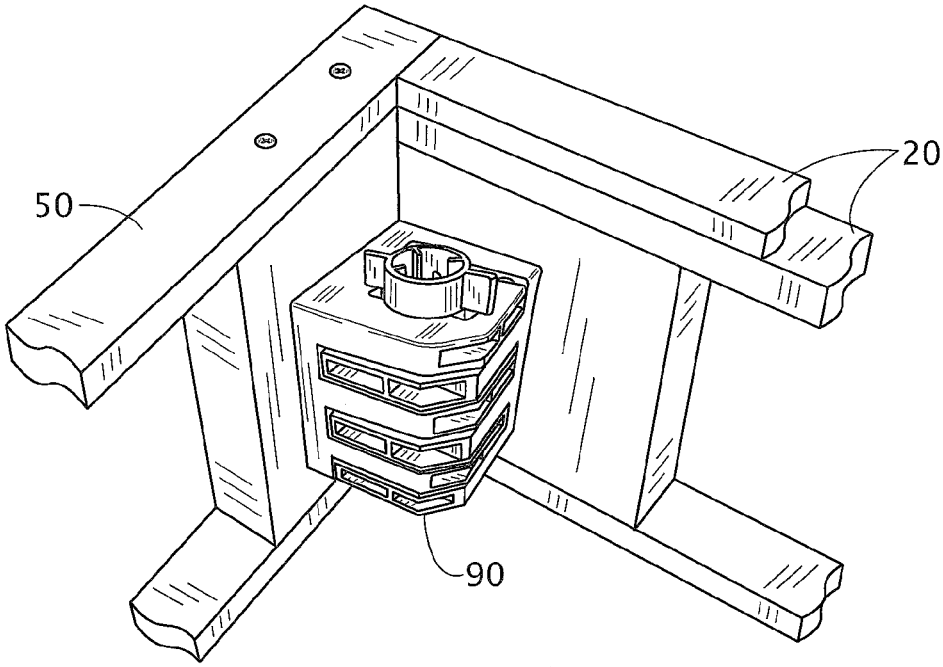
FIG. 3 is a top perspective view of the inside of a corner of an embodiment of the ready-to-assemble foundation.

FIG. 3 shows an inside corner of the foundation 10 including a connector 90. The exterior beam 20 is coupled to the transverse end members 30 with the connector 90. This structure is replicated at the other corners of the outer frame of the foundation 10. The connector is made of three components, a right corner block 68, a left corner block 70, and a pin 72. The right corner block 68, left corner block 70, and pin 72 can be made of injection molded plastic, such as glass-filled nylon.

Figure 8:
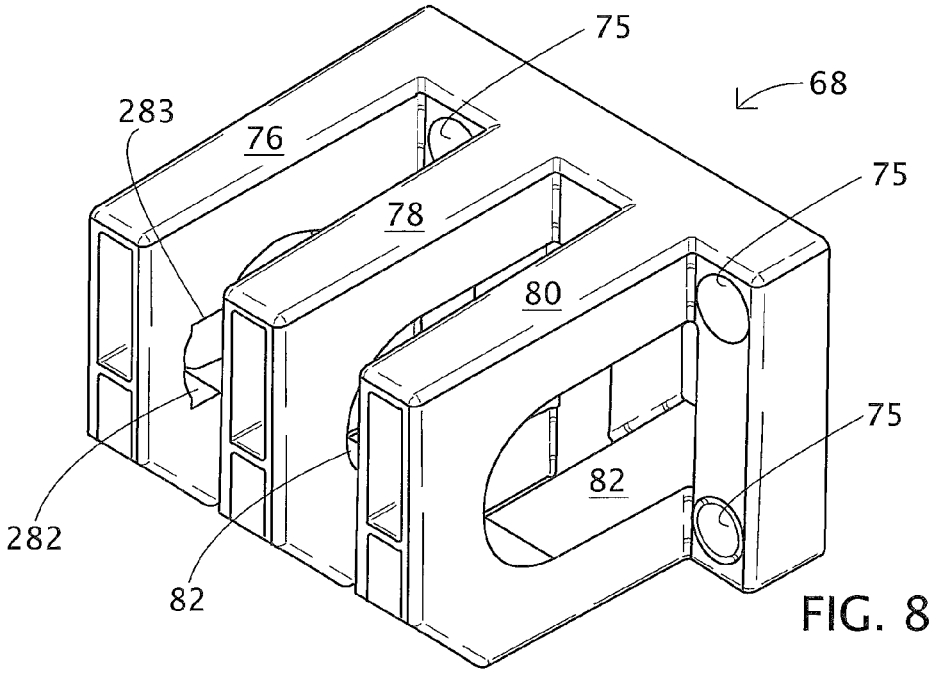
FIG. 8 is a perspective view of a first corner connector.
Figure 9:
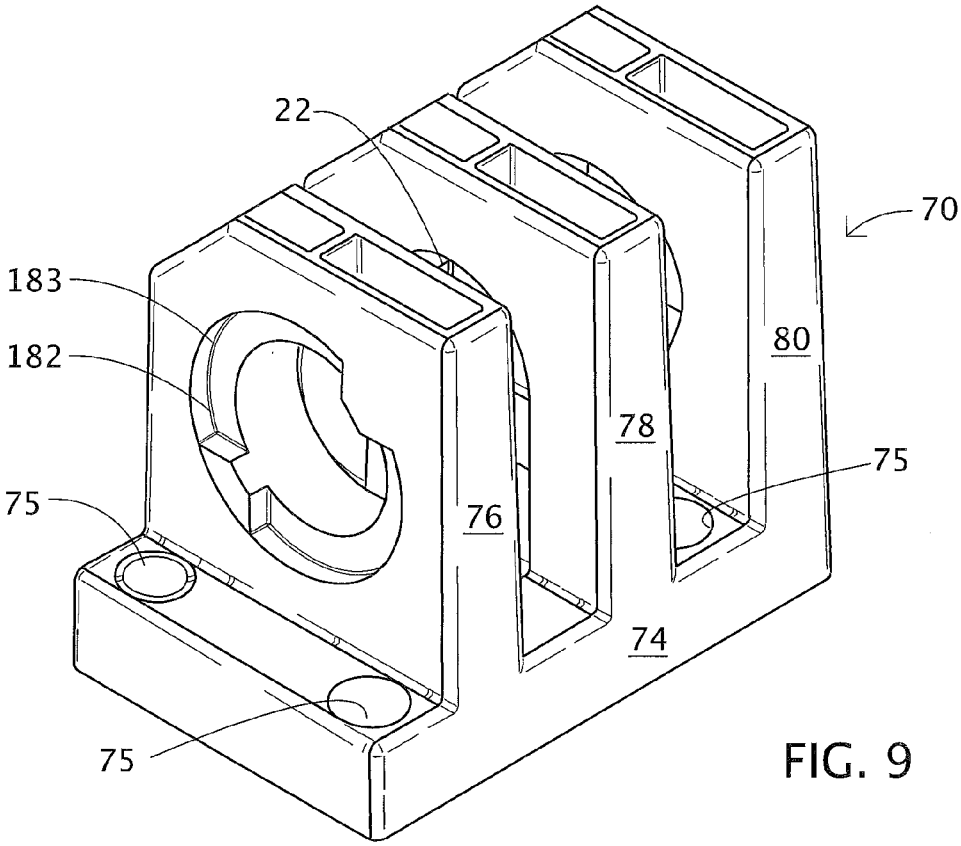
FIG. 9 is a perspective view of a second corner connector configured to cooperate with the first corner connector.
Figure 10:
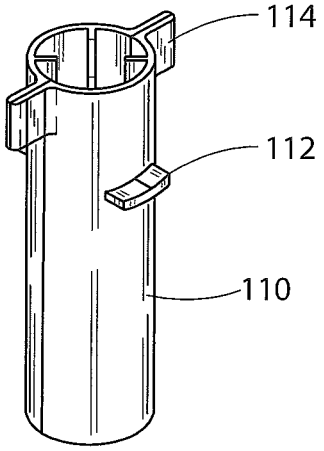
FIG. 10 is a perspective view of a pin for use with the first and second corner connectors.

As seen in FIGS. 8 and 9, the corner blocks 68 and 70 each have a mounting flange 74 having holes 75 for screws to pass through and into the respective beams 20, 30, 40 and 50 to hold the corner block in place. The mounting flange 74 has three upstanding lamella 76, 78, 80, each with a shaped lumen 82, 182, 282. The upstanding lamella can interleave with lamella of an adjacent block. The lumens are coaxial and have at least portions that are substantially cylindrical, so that they can securely receive a pin 110 (see FIG. 10) that engages inside walls of the lumens snuggly and avoids wiggles or squeaks. Lumen 182 of lamella 76 of the block 79 includes a partially circumferential recess 183 extending three quarters of the way around the lumen, making a space for a flange 112 of pin 110. Lumen 282 of lamella 76 of the block 68 includes two opposed keyways 283 (only one is shown in FIG. 8), providing a path for the flange 112 to pass through when the pin 110 is inserted into the aligned lumens to reside within the recess 183. As seen in FIG. 10, the pin is preferably hollow.

In a preferred embodiment, the keyways 283 align with one or the other of the ends of the partially circumferential recess 183. That positioning permits the flange 112 to be inserted to be resident in the recess 183 and for the pin 110 to be turned using handles 114 to no longer be aligned with the keyways, preventing a simple pulling motion to remove the pin. If disassembly is desired, the handles can be turned to re-align the flanges with the keyways, so the pin can be withdrawn, and the two blocks 68 and 70 can be pulled apart. Since the blocks 68 and 70 are mounted on the beams, pulling the blocks apart results in the separation the beams and to disassemble the foundation.

Figure 13:
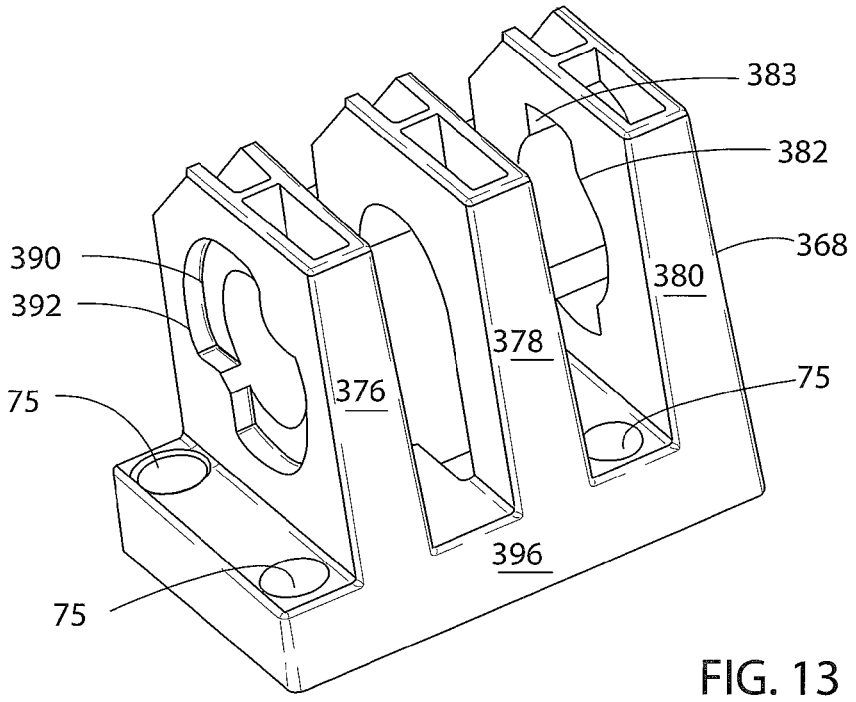
FIG. 13 is a perspective view of a third corner connector adapted to be used with another third corner connector.
Figure 14:
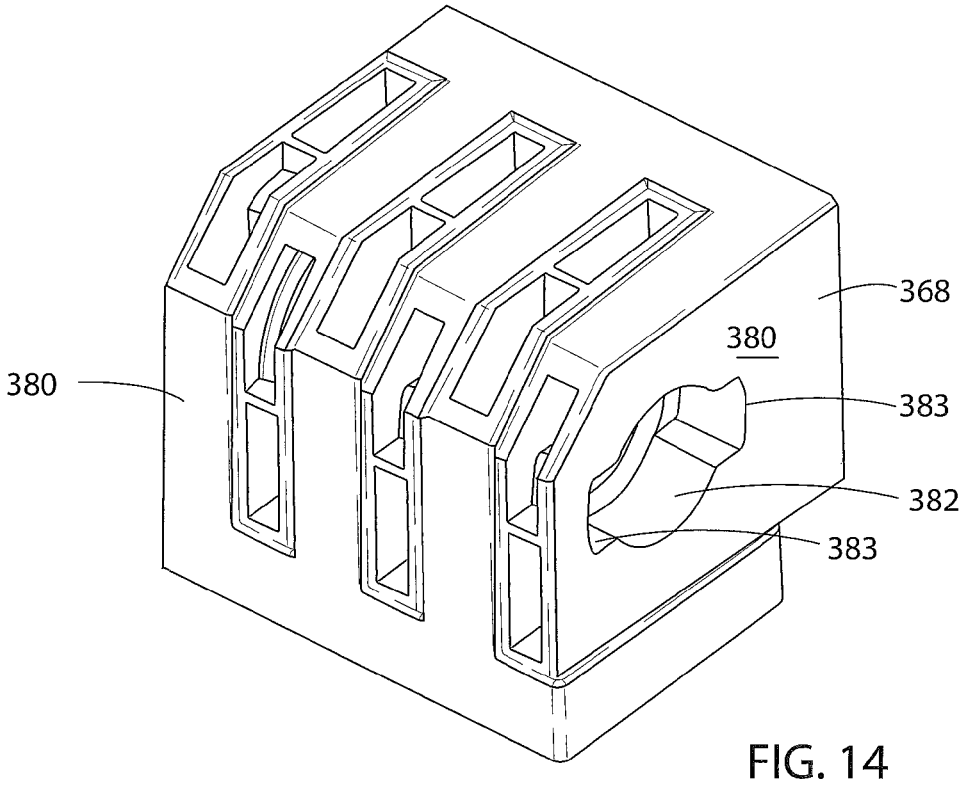
FIG. 14 is a perspective view of two third corner connectors joined together awaiting pin insertion.

FIGS. 13 and 14 show blocks that combine the features of the two corner block designs above into one block, so only one mold would be needed, and the one molded block serves where two different blocks 68, 70 were used above. In addition to reducing the cost of the mold, this design simplifies inventory for foundation preparation (one SKU, instead of two) and simplifies the mounting of the blocks on the bed frame beams, since there is no wrong choice of block for an installer. Furthermore, this design permits the pin to be inserted from either direction, which can be another benefit.

As seen in FIG. 13, the corner blocks 368 each have a mounting flange 74 having holes 75 for screws to pass through and into the respective beams 20, 30, 40 and 50 to hold the corner block in place. The mounting flange 74 has three upstanding lamella 376, 378, 380, each with a shaped lumen. The lumens are coaxial and have at least portions that are substantially cylindrical, so that they can securely receive a pin 110, as before. Lumen 390 of lamella 376 of includes a partially circumferential recess 392 extending three quarters of the way around the lumen, making a space for the flanges 112 of pin 110. Lumen 382 of lamella 380 includes two opposed keyways 383, providing a path for the flanges 112 to pass through when the pin 110 is inserted into the aligned lumens to reside within the recess 183.

FIG. 14 shows two of the blocks 368 engaged, but without the pin inserted. In either end of the aligned lumens, the keyway 383 provides a path for the flange 112 of the pin to travel to become resident in recess 292. Turning the pin locks the blocks together.

As seen FIG. 13 the lumens of lamella 376 and 380 are circular (other than the recess 392 and keyways 383). The lumen of lamella 378 is arched, with the curved part of the arch being aligned with the inside of the lumens of lamella 376 and 380, forming a surface of right cylinder. The arch, design allows a little flexion during pin insertion, with a tight fit to improve surface contact, which helps minimize squeaks. The tighter fit improves the strength, with each lamella supporting the other more directly.

Figure 4:
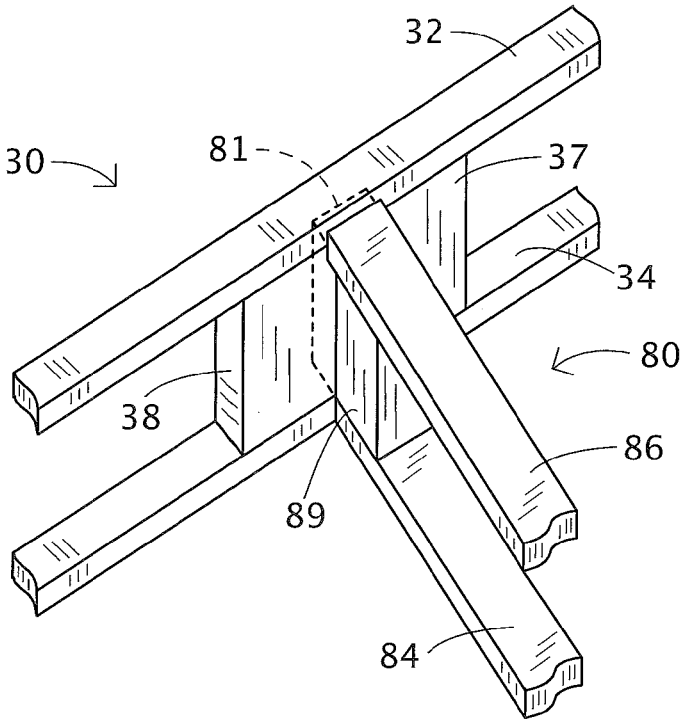
FIG. 4 is a top perspective view of a joint between an interior beam and a transverse end member of an embodiment of a ready-to-assemble foundation for a bed.

FIG. 4 is view of an end of the interior beam 80, which also includes an upper member 86 and lower member 84 spaced vertically by a plurality of blocks such as the blocks 83 (shown in FIG. 1) and 89. The upper member 86 includes a generally horizontal planar surface for supporting the slats 70 without the need for fastening the slats 70 to the member 86. The beam 80 includes two opposing end portions, such as the end portion 81 shown, which is configured extend into the opening between the blocks 37 and 38 of the transverse end member 30 when the foundation is assembled.

Figure 5:
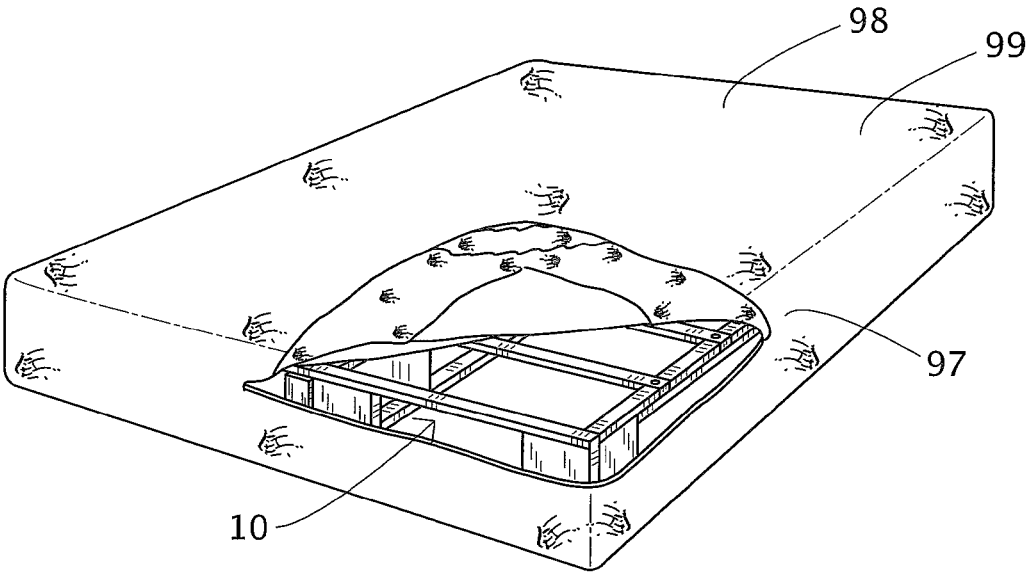
FIG. 5 is a top perspective view of a slipcover on the ready-to-assemble bed foundation.

FIG. 5 shows the foundation 10 with a slipcover 98 over the generally rectangular frame of the foundation 10. The slipcover 98 may optionally include an integrally formed padding 99 for placement above the foundation and a zipper seam 97 to facilitate installation of the foundation 10 in the slipcover 98.

Figure 6:
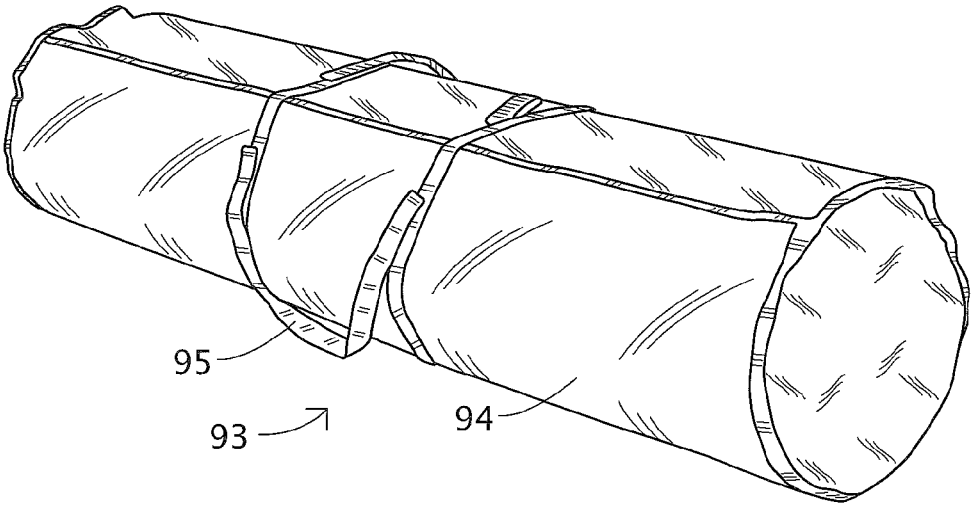
FIG. 6 is a top perspective view of a mattress suitable for use with embodiments of the foundation in a mattress container.

FIG. 6 shows a mattress 94 in a collapsed configuration. The mattress 94 shown is vacuum-packed into a handy transparent shipping and carrying bag 93 including handles 95. The disassembled foundation 10 can likewise be packaged in a carton, with or without carrying handles, or bag such as the bag 93 shown. The bag 93 provides a convenient container for carrying the mattress 94 and/or bed foundation 10 from a store to a vehicle, and further for transport from the vehicle into a residence for assembly. Alternatively, the mattress 94 can be sold to a customer from a catalogue or internet site and shipped in this collapsed configuration.

Figure 7:
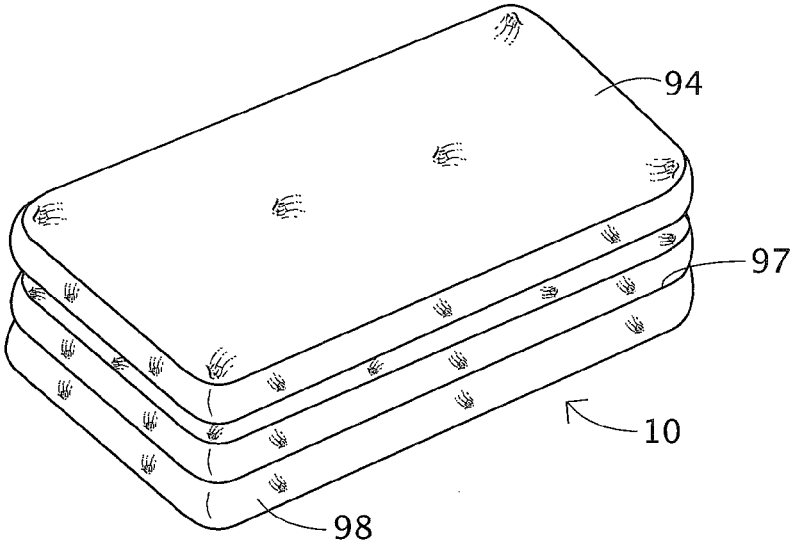
FIG. 7 is a top perspective view of an embodiment of a bed foundation having an optional slipcover and a mattress atop the foundation and slipcover.

FIG. 7 shows the mattress 94 in an uncollapsed configuration atop the foundation 10 and optional slipcover 98. A consumer can convert the mattress to the uncollapsed configuration shown after transport to a residence by simply removing the mattress 94 from the bag 93 shown in FIG. 5, unrolling it and allowing it to allow the mattress to expand.

The bed foundation can be provided in various sizes including but not limited to twin, double, queen, king and California king.

Figure 11:
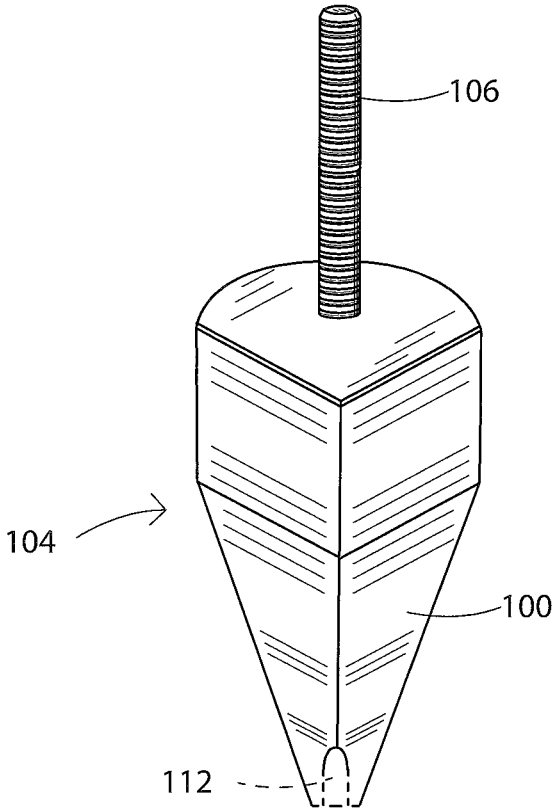
FIG. 11 is a perspective view of a combined foot and connecting pin.

FIG. 11 shows a bed foot 104, enabling the use of the foundation without a bed frame. The foot 104 includes a pin 106 having a straight, threaded shaft to pass through the center of installed pin 110 and receive a nut (not shown), such as a wingnut. The foot portion 100 extends down below the connector toward the floor. The foot portion 100 can make contact with the floor, or more preferably, a glide or caster (not shown) is inserted in a hole 112 at the bottom of the foot 100. Thus, the side beams and transverse end members have connectors adjacent ends thereof, the connectors including flanges that can be interleaved with aligned openings through the interleaved flanges, and pins extend through the aligned openings receive the pins and the feet for the foundation to rest on a floor. Other forms of connection of the foot to the pin can be used, such as a press-fit shape on the top of the foot, or connections other than a threading with a nut.

Figure 12:
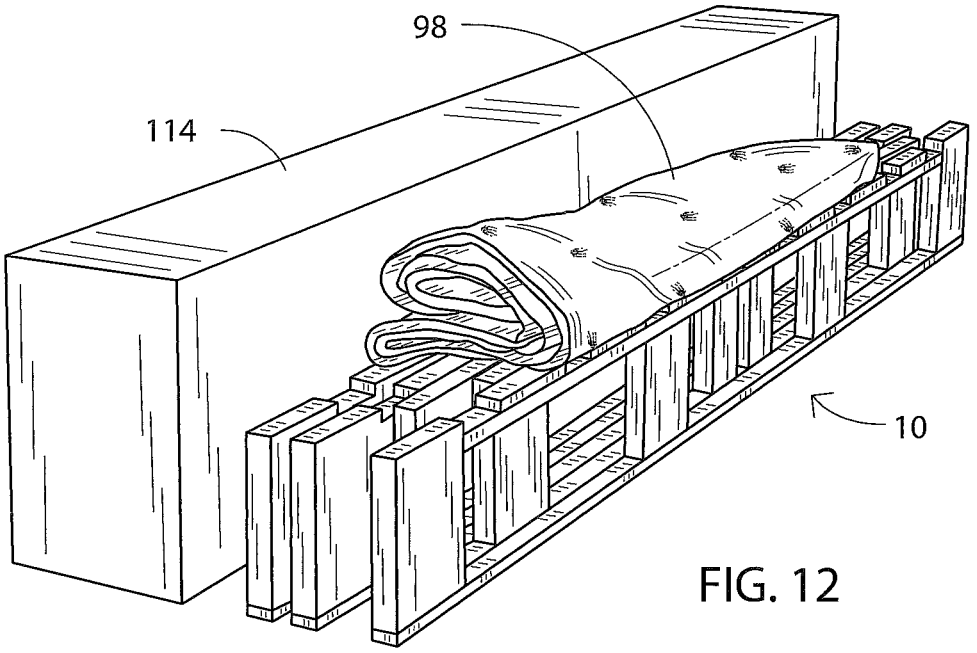
FIG. 12 is a perspective view of the ready to assemble foundation with slip cover adjacent a shipping carton sized and configured to receive the ready to assemble foundation with slip cover.

FIG. 12 shows the foundation unassembled, with the slipcover 98 folded on top. As can be seen, these collapsed components can fit into a carton 114 for easy shipping and storage.

Certain modifications and improvements will occur to those skilled in the art upon a reading of the foregoing description. All such modifications and improvements have not been included herein but may properly fall within the scope of the appended claims.

We claim:

1. A ready-to-assemble bed foundation comprising:

a pair of exterior side beams, each side beam having two ends, a pair of transverse end members, each end member having two ends, each of the side beams and end members having a corner block attached to each of its ends, the corner blocks being configured to mate together with another corner block to make a pair of corner blocks to hold one of the side beams in contact at a right angle to one of the end members, the mated corner blocks configured to be held together by a pin, a pin with a flange for each pair of corner blocks, the corner blocks each having a mounting flange to mount that block to the respective beam or end member and upstanding lamella that can interleave with lamella of the other corner block of the pair, each lamella having a shaped lumen that is coaxial with the lumens of the other lamella of that block and that has at least portions that are substantially cylindrical, so that each lumen can receive one of the pins, one lumen of an lamella at an end of each block having a segment that extends outward to form a circumferential recess in that lamella, making a space for the flange of the pin, the lumen of a lamella adjacent the end lamella including a keyway providing a path for the flange of the pin to pass through when the pin is inserted into the coaxial lumens to reside within the circumferential recess.

2. A ready-to-assemble bed foundation as claimed in claim 1 wherein the circumferential recess extends three quarters of the way around the lumen.

3. A ready-to-assemble bed foundation as claimed in claim 1 wherein the corner blocks are identical to one another.

4. A ready-to-assemble bed foundation as claimed in claim 1 wherein the pin is hollow.

5. A ready-to-assemble bed foundation as claimed in claim 1 wherein at least one lamella has a lumen is that is arch-shaped and open toward the mounting flange of the corner block of which the lamella having the arch-shaped lumen is attached.

6. A ready-to-assemble bed foundation as claimed in claim 4 further comprising a foot having a threaded rod at the top of the foot that can be passed through the hollow pin and held in place with a nut.

7. The ready-to-assemble bed foundation according to claim 1 further including a slipcover for placement over the foundation.

8. The ready-to-assemble bed foundation according to claim 1 further including a collapsible mattress.

9. The ready-to-assemble bed foundation according to claim 1 further including slats that can be installed to span the exterior beams as assembled.

10. A ready-to-assemble bed foundation comprising:

a pair of exterior side beams, each side beam having two ends, a pair of transverse end members, each end member having two ends, each of the side beams and end members having a corner block attached to each of its ends, the corner blocks being configured to mate together with another corner block to make a pair of corner blocks to hold one of the side beams in contact at a right angle to one of the end members, the mated corner blocks configured to be held together by a pin, a hollow pin with a flange for each pair of corner blocks, the corner blocks each having a mounting flange to mount that block to the respective beam or end member and upstanding lamella that can interleave with lamella of the other corner block of the pair, each lamella having a shaped lumen that is coaxial with the lumens of the other lamella of that block and that has at least portions that are substantially cylindrical, so that each lumen can receive one of the pins, one lumen of an lamella at an end of each block having as segment that extends outward to form a circumferential recess in that lamella extending three quarters of the way around the lumen to make a space for the flange of the pin, the lumen of an opposite lamella including a keyway providing a path for the flange of the pin to pass through when the pin is inserted into the coaxial lumens to reside within the circumferential recess, at least one lumen being arch-shaped, a foot having a threaded rod at its top, so the threaded rod can be passed through the pin and held in place with a nut, slats that can be installed to span the exterior beams as assembled, and a slipcover for placement over the foundation, and a collapsible mattress.

11. A ready-to-assemble bed foundation as claimed in claim 10 wherein the corner blocks are identical to one another.

* * * * *